US012624873B2

(12) United States Patent
Ma et al.

(10) Patent No.: US 12,624,873 B2
(45) Date of Patent: May 12, 2026

(54) REFRIGERATION SYSTEM AND REFRIGERATING APPLIANCE

(71) Applicants: QINGDAO HAIER REFRIGERATOR CO., LTD., Shandong (CN); HAIER SMART HOME CO., LTD., Shandong (CN)

(72) Inventors: Jian Ma, Shandong (CN); Lisheng Ji, Shandong (CN); Jianquan Chen, Shandong (CN); Zhanpeng Cui, Shandong (CN); Xianghui Zhao, Shandong (CN); Fei Xing, Shandong (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 131 days.

(21) Appl. No.: 18/575,105

(22) PCT Filed: May 25, 2022

(86) PCT No.: PCT/CN2022/094978
§ 371 (c)(1),
(2) Date: Dec. 28, 2023

(87) PCT Pub. No.: WO2023/273707
PCT Pub. Date: Jan. 5, 2023

(65) Prior Publication Data

US 2024/0302086 A1 Sep. 12, 2024

(30) Foreign Application Priority Data

Jun. 29, 2021 (CN) ..... 202110730107.1

(51) Int. Cl.
*F25B 47/02* (2006.01)
*F25B 41/20* (2021.01)
*F25B 49/02* (2006.01)

(52) U.S. Cl.
CPC ..... *F25B 47/02* (2013.01); *F25B 41/20* (2021.01); *F25B 49/02* (2013.01); *F25B 2400/0409* (2013.01)

(58) Field of Classification Search
CPC ..... F25B 47/02; F25B 41/20; F25B 49/02; F25B 2400/0409
See application file for complete search history.

(56) References Cited

U.S. PATENT DOCUMENTS

2009/0173091 A1* 7/2009 Hu ..... F25B 47/022 62/277
2017/0030615 A1 2/2017 Kim

FOREIGN PATENT DOCUMENTS

CN 103017427 A 4/2013
CN 204202286 U 3/2015
(Continued)

OTHER PUBLICATIONS

Isojima et al., Refrigerator, Oct. 13, 2000, JP2000283626A, Whole Document (Year: 2000).*

*Primary Examiner* — Larry L Furdge
(74) *Attorney, Agent, or Firm* — MUNCY, GEISSLER, OLDS & LOWE, P.C.

(57) ABSTRACT

A refrigeration system includes: a refrigeration assembly including a compressor, a first evaporator, and a second evaporator; and a first defrost bypass pipeline and a second defrost bypass pipeline for circulating refrigerant from the compressor to generate heat; the first defrost bypass pipeline is thermally connected to the first evaporator, the second defrost bypass pipeline is thermally connected to the second evaporator; one evaporator provides cooling when the
(Continued)

defrost bypass pipelines heat another evaporator, so as to prevent temperature fluctuations in a storage compartment of the refrigerating appliance. The refrigerating apparatus includes a cabinet and the refrigeration system.

8 Claims, 6 Drawing Sheets

(56) References Cited

FOREIGN PATENT DOCUMENTS

| | | | | |
|---|---|---|---|---|
| CN | 105466112 | A | | 4/2016 |
| CN | 107525316 | A | | 12/2017 |
| CN | 108224828 | A | | 6/2018 |
| CN | 216409376 | U | | 4/2022 |
| JP | S5459650 | A | | 5/1979 |
| JP | S63223477 | A | | 9/1988 |
| JP | H04356677 | A | | 12/1992 |
| JP | 2000282626 | A | * | 10/2000 |

* cited by examiner

REFRIGERATION SYSTEM AND REFRIGERATING APPLIANCE

TECHNICAL FIELD

The present subject matter relates to refrigeration, particularly to a refrigeration system and a refrigerating appliance.

BACKGROUND

Refrigerating appliances, such as refrigerators, freezers, and refrigerated cabinets, use refrigeration systems for cooling. During the operation of refrigeration systems, due to a low temperature, surfaces of an evaporator is prone to frost, which can reduce the cooling efficiency of the evaporator. Therefore, it is necessary to defrost the evaporator timely.

Some refrigerating appliances in prior arts use electric heating wires to heat the evaporator for defrosting. This defrosting method not only has a slow defrosting rate and a long time but also causes a significant temperature rise in the storage compartment. Hence, there is a need to improve the defrosting method of the evaporator.

SUMMARY

One objective of this invention is to overcome at least one technical defect in prior arts by providing a refrigeration system and a refrigerating appliance.

A further objective is to improve the defrosting method of an evaporator, so as to increase the defrosting rate of the evaporator while effectively preventing significant temperature fluctuations in a storage compartment.

Another further objective is to extend the lifespan of the refrigeration system.

Another further objective is to improve the energy efficiency of the refrigeration system and the refrigerating appliance.

An additional further objective is to simplify the structure and the control process of the refrigeration system.

According to an embodiment of the present subject matter, a refrigeration system for a refrigerating appliance comprises: a refrigeration assembly comprising a compressor, a first evaporator, and a second evaporator, forming a refrigeration circuit; and defrost bypass pipelines having a first defrost bypass pipeline and a second defrost bypass pipeline for circulating refrigerant from the compressor to generate heat; the first defrost bypass pipeline is thermally connected to the first evaporator, and the second defrost bypass pipeline is thermally connected to the second evaporator; the refrigeration system is configured to provide cooling by one evaporator when the defrost bypass pipelines heat another evaporator, so as to prevent temperature fluctuations in a storage compartment of the refrigerating appliance.

Optionally, the refrigeration system further comprises: cooling bypass pipelines comprising a first cooling bypass pipeline and a second cooling bypass pipeline; wherein, the first cooling bypass pipeline is connected to the first defrost bypass pipeline, for guiding the refrigerant flowing through the first defrost bypass pipeline to the second evaporator, so that the second evaporator generates cooling; the second cooling bypass pipeline is connected to the second defrost bypass pipeline, for guiding the refrigerant flowing through the second defrost bypass pipeline to the first evaporator, so that the first evaporator generates cooling.

Optionally, the first cooling bypass pipeline is connected to the inlet of the second evaporator, a first bypass throttling device is arranged on the first cooling bypass pipeline for throttling the refrigerant flowing towards the second evaporator.

Optionally, the second cooling bypass pipeline is connected to the inlet of the first evaporator, a second bypass throttling device is arranged on the second cooling bypass pipeline for throttling the refrigerant flowing towards the first evaporator.

Optionally, the refrigeration system further comprises: a bypass return pipeline connecting the outlet of the first evaporator to a suction port of the compressor, and used for guiding the refrigerant flowing successively through the second cooling bypass pipeline and the first evaporator to the suction port of the compressor when the second defrost bypass pipeline heats the second evaporator.

Optionally, the refrigeration system further comprises: a first switching valve connected to the outlet of the first evaporator, and having a valve port connecting to the second evaporator, and a valve port connecting to the bypass return pipeline; the first switching valve opens the valve port connecting to the bypass return pipeline when the second defrost bypass pipeline heats the second evaporator using generated heat, and opens the valve port connecting to the second evaporator when both the first and second evaporators provide cooling.

Optionally, the first evaporator and the second evaporator are sequentially connected downstream of an exhaust port of the compressor; the refrigeration assembly further comprises a refrigeration throttling device setting in the refrigeration circuit and upstream of the first evaporator, and the refrigeration throttling device throttle the refrigerant flowing towards the first evaporator; and the second cooling bypass pipeline is connected to the inlet of the refrigeration throttling device.

Optionally, the refrigeration assembly further comprises a condenser connected between the exhaust port of the compressor and the refrigeration throttling device; and the refrigeration system further comprises a second switching valve connected to the exhaust port of the compressor and having a valve port connecting to the condenser, a valve port connecting to the first defrost bypass pipeline, and a valve port connecting to the second defrost bypass pipeline; the second switching valve opens the valve port connecting to the condenser when both the first and second evaporators provide cooling, opens the valve port connecting to the first defrost bypass pipeline when the first defrost bypass pipeline heats the first evaporator using generated heat, and opens the valve port connecting to the second defrost bypass pipeline when the second defrost bypass pipeline heats the second evaporator using generated heat.

Optionally, the first defrost bypass pipeline is either coiled around the first evaporator or set adjacent to the first evaporator; the second defrost bypass pipeline is either coiled around the second evaporator or set adjacent to the second evaporator.

According to another embodiment of the present subject matter, a refrigerating appliance comprises: a cabinet forming a storage compartment inside; and any one of above-mentioned refrigeration system; where the first and second evaporators respectively provide cooling to the storage compartment.

The refrigeration system and refrigerating appliance of the present invention, provides a novel defrosting method by improving the structure of the refrigeration system. Since the refrigeration circuit includes the first evaporator and the second evaporator, each evaporator is thermally connected to a defrost bypass pipeline and can utilize the heat generated by the defrost bypass pipeline for defrosting. By adjusting the circulation of refrigerant in the first and second defrost bypass pipeline, the first and second evaporator can be defrosted independently. When the first and second evaporator are defrosted independently, the evaporator not undergoing defrosting can provide cooling, which enables the refrigeration system of this embodiment to effectively prevent significant temperature fluctuations in the storage compartment while improving the defrosting rate of the evaporators.

Further, the refrigeration system and refrigerating appliance of the present invention, compared with the scheme of directly introducing high-pressure or high-temperature refrigerant flowing out of the compressor into the evaporator to switch the evaporator to a condenser, uses the added defrost bypass pipelines to heat the evaporators for defrosting. This defrosting method can avoid the need for the evaporators to switch to condensers, thus reducing or preventing the abrupt cooling or heating of the evaporators and the condenser caused by the functional switching of the evaporators and the condenser, beneficially extending the overall service life of the refrigeration system and reducing maintenance costs.

Furthermore, the refrigeration system and refrigerating appliance of the present invention, when one evaporator is defrosting, the refrigerant flowing through the defrost bypass pipeline that heats this evaporator can be supplied to the other evaporator after throttled, so that the other evaporator can provide cooling. This cooperative functioning of the two evaporators, combines defrosting and cooling functionalities organically. Thus, it enables the refrigeration system of this embodiment to effectively utilize the mechanical work of the compressor, beneficial for improving the energy efficiency of both the refrigeration system and the refrigerating appliance.

Moreover, the refrigeration system and refrigerating appliance of the present invention, by using defrost bypass pipelines, cooling bypass pipelines, and switching valves to improve the connection structure of the refrigeration system, enables sequentially connected evaporators to defrost without temperature rise, and enhances the preservation performance of the refrigerating appliance. This is beneficial for simplifying the structure and the control process of the refrigeration system.

The above and other objects, advantages and features of the present utility model will become more apparent to those skilled in the art from the following detailed description of specific embodiments thereof taken in conjunction with the accompanying drawings.

BRIEF DESCRIPTION OF THE DRAWINGS

Some specific embodiments of the utility model will be described in detail hereinafter by way of example and not by way of limitation with reference to the accompanying drawings. The same reference numerals identify the same or similar components or parts in the drawings. Those skilled in the art should appreciate that the drawings are not necessarily drawn to scale. In the drawings.

DETAILED DESCRIPTION

Figure 1:
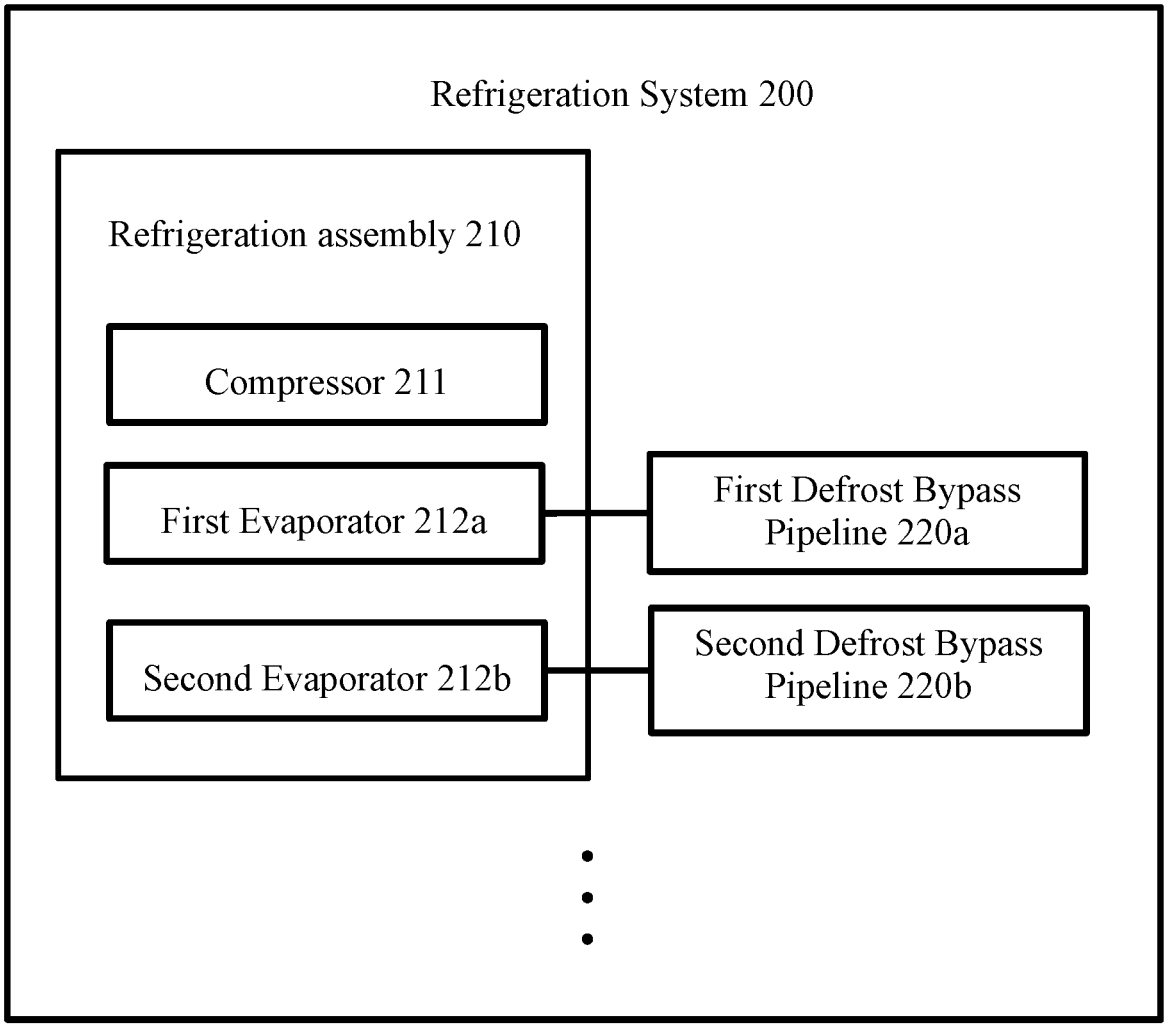
FIG. 1 is a schematic block diagram of a refrigeration system for a refrigerating appliance according to an embodiment of the present subject matter.

FIG. 1 is a schematic block diagram of a refrigeration system 200 for a refrigerating appliance 10 according to an embodiment of the present subject matter.

The refrigeration system 200 generally includes a refrigeration assembly 210 and a bypass assembly, where the bypass assembly include defrost bypass pipelines. The refrigeration assembly 210 are utilized to form a refrigeration circuit. In the absence of defrosting the evaporator, the refrigeration system 200 only utilizes the refrigeration circuit for cooling the evaporator. The bypass assembly are connected to the refrigeration circuit, for example, may be attached to the refrigeration circuit, to form a bypass branch. The refrigeration circuit and the bypass branch can both circulate refrigerant. The refrigeration system 200 modulates the working state of the evaporator by adjusting the flow path of the refrigerant in the refrigeration circuit and the bypass branch. The working states of the evaporator include a cooling state and a defrosting state.

Figure 2:
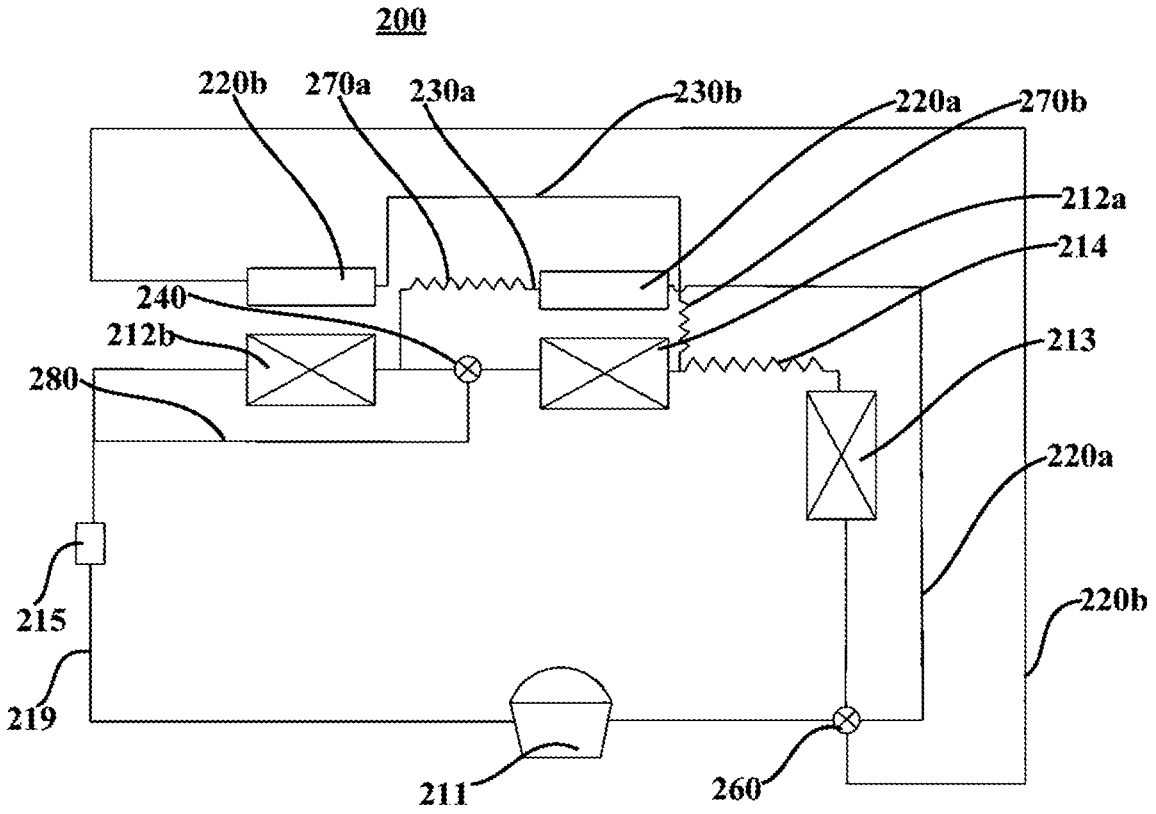
FIG. 2 is a schematic structural diagram of a refrigeration system for refrigerating appliance according to an embodiment of the present subject matter.

FIG. 2 is a schematic structural diagram of a refrigeration system 200 for refrigerating appliance 10 according to an embodiment of the present subject matter.

The refrigeration assembly 210 include a compressor 211, a first evaporator 212*a*, and a second evaporator 212*b*, forming the refrigeration circuit. The first evaporator 212*a* and the second evaporators 212*b* respectively, provide cooling to the storage compartment 110 of the refrigerating appliance 10. The first evaporator 212*a* and the second evaporators 212*b* are respectively connected downstream of an exhaust port of the compressor 211. Within the refrigeration circuit, the first evaporator 212*a* and the second evaporators 212*b* can be arranged in parallel or in series with each other. In this embodiment, the structure of the refrigeration system 200 is further elaborated, taking the case of the first evaporator 212*a* and the second evaporators 212*b* are interconnected in series. Those skilled in the art should be fully capable of altering the number and connection mode of the evaporators based on the understanding of this embodiment, and further examples are not enumerated here.

The defrost bypass pipelines include a first defrost bypass pipeline 220*a* and a second defrost bypass pipeline 220*b* for circulating refrigerant from the compressor 211 to generate heat. The first defrost bypass pipeline 220*a* is thermally connected to the first evaporator 212*a*, and the second defrost bypass pipeline 220*b* is thermally connected to the second evaporator 212*b*. In other words, the first defrost bypass pipeline 220*a* corresponds to the first evaporator 212*a* and is used to heat the first evaporator 212*a*, and similarly, the second defrost bypass pipeline 220*b* corresponds to the second evaporator 212*b* and is used to heat the second evaporator 212*b*. Each evaporator can be defrosted using the heat generated by its corresponding defrost bypass pipeline. The refrigeration system 200 is configured to provide cooling by one evaporator when one defrost bypass pipeline is heating another evaporator, so as to prevent temperature fluctuations in the storage compartment 110.

By improving the structure of the refrigeration system 200, the embodiment provides a novel defrosting method. Since each evaporator is thermally connected to a defrost bypass pipeline and can utilize the heat generated by the defrost bypass pipeline for defrosting. By adjusting the circulation of refrigerant in the first defrost bypass pipeline 220*a* and the second defrost bypass pipeline 220*b*, the first evaporator 212*a* and the second evaporator 212*b* can be defrosted independently. When the first evaporator 212*a* and the second evaporator 212*b* are defrosted independently, the evaporator not undergoing defrosting can provide cooling, which enables the refrigeration system 200 of this embodiment to effectively prevent significant temperature fluctuations in the storage compartment 110 while improving the defrosting rate of the evaporators.

For example, an inlet of each defrosts bypass pipeline can be connected to the exhaust port of the compressor 211 through connecting pipelines, or can connect with a certain section downstream of the exhaust port of the compressor 211, as long as high-pressure or high-temperature refrigerant flowing out of the compressor 211 can be introduced. The refrigerant can release heat and condense while flowing through the defrost bypass pipelines, thereby generating heat.

The above-mentioned connecting pipelines can have the same structure as connecting pipelines between various components within the refrigeration circuit, as long as they can guide the refrigerant. The structure of the defrost bypass pipelines can be roughly the same as condensing tubes of a condenser 213, as long as they can enable the high-pressure or high-temperature refrigerant flowing through them to condense and release heat.

Compared with the scheme of directly introducing high-pressure or high-temperature refrigerant flowing out of the compressor 211 into the evaporator to switch the evaporator to a condenser, this embodiment uses the added defrost bypass pipelines to heat the evaporators for defrosting. This defrosting method can avoid the need for the evaporators to switch to condensers, thus reducing or preventing the abrupt cooling or heating of the evaporators and condenser 213 caused by the functional switching of the evaporators and condenser 213, beneficially extending the overall service life of the refrigeration system 200 and reducing maintenance costs.

The first defrost bypass pipeline 220*a* is coiled around the first evaporator 212*a* or is set adjacent to the first evaporator 212*a* to achieve thermal connection. Similarly, the second defrost bypass pipeline 220*b* is coiled around the second evaporator 212*b* or is set adjacent to the second evaporator 212*b* for thermal connection. Coiling the defrost bypass pipelines around the evaporators increases the contact area between the defrost bypass pipelines and the evaporators, thereby improving the heat transfer efficiency and facilitating rapid defrosting of the evaporators. Setting the defrost bypass pipelines adjacent to the evaporators simplifies the process of establishing a thermal connection and reduces manufacturing costs.

The bypass assembly may further include cooling bypass pipelines, consisting of a first cooling bypass pipeline 230*a* and a second cooling bypass pipeline 230*b*. The first cooling bypass pipeline 230*a* is connected to the first defrost bypass pipeline 220*a* and guides the refrigerant flowing through the first defrost bypass pipeline 220*a* to the second evaporator 212*b*, enabling the second evaporator 212*b* to produce cooling. The second cooling bypass pipeline 230*b* is connected to the second defrost bypass pipeline 220*b* and guides the refrigerant flowing through the second defrost bypass pipeline 220*b* to the first evaporator 212*a*, enabling the first evaporator 212*a* to produce cooling.

In other words, the first cooling bypass pipeline 230*a* serves as a "connecting channel" between the first defrost bypass pipeline 220*a* and the second evaporator 212*b*, and it guides the refrigerant flowing through the first defrost bypass pipeline 220*a* to the second evaporator 212*b* when the first evaporator 212*a* is being defrosted, so that the second evaporator 212*b* can use the introduced refrigerant for cooling. The second cooling bypass pipeline 230*b* serves as a "connecting channel" between the second defrost bypass pipeline 220*b* and the first evaporator 212*a*, and it guides the refrigerant flowing through the second defrost bypass pipeline 220*b* to the first evaporator 212*a* when the second evaporator 212*b* is being defrosted, so that the first evaporator 212*a* can use the introduced refrigerant for cooling.

The first cooling bypass pipeline 230*a* is connected to an inlet of the second evaporator 212*b* and is equipped with a first bypass throttling device 270*a* used for throttling the refrigerant flowing towards the second evaporator 212*b*. When the first evaporator 212*a* is defrosting using the heat generated by the first defrost bypass pipeline 220*a*, the first cooling bypass pipeline 230*a* utilizes the first bypass throttling device 270*a* to throttle the refrigerant exiting the first defrost bypass pipeline 220*a* and flowing towards the second evaporator 212*b*. That is, while guiding the refrigerant, the first cooling bypass pipeline 230*a* utilizes the first bypass throttling device 270*a* to throttle the refrigerant, so that the throttled refrigerant can evaporate and absorb heat when passing through the second evaporator 212*b*, thereby enabling the second evaporator 212*b* to provide cooling.

The second cooling bypass pipeline 230*b* is connected to an inlet of the first evaporator 212*a* and is equipped with a second bypass throttling device 270*b* used for throttling the refrigerant flowing towards the first evaporator 212*a*. When the second evaporator 212*b* is defrosting using the heat generated by the second defrost bypass pipeline 220*b*, the second cooling bypass pipeline 230*b* utilizes the second bypass throttling device 270*b* to throttle the refrigerant exiting the second defrost bypass pipeline 220*b* and flowing towards the first evaporator 212*a*. That is, while guiding the refrigerant, the second cooling bypass pipeline 230*b* utilizes the second bypass throttling device 270*b* to throttle the refrigerant, so that the throttled refrigerant can evaporates and absorbs heat when passing through the first evaporator 212*a*, thereby enabling the first evaporator 212*a* provide cooling.

The refrigeration system 200 of this embodiment, when one evaporator is defrosting, the refrigerant flowing through the defrost bypass pipeline that heats this evaporator can be supplied to the other evaporator after throttled, so that another evaporator can provide cooling. This cooperative functioning of the two evaporators, combines defrosting and cooling functionalities organically. Thus, it enables the refrigeration system 200 of this embodiment to effectively utilize the mechanical work of the compressor 211, beneficial for improving the energy efficiency of both the refrigeration system 200 and the refrigerating appliance 10.

The bypass assembly may further include a bypass return pipeline 280, which connects an outlet of the first evaporator 212*a* to a suction port of the compressor 211. The bypass return pipeline 280 is used for guiding the refrigerant, which sequentially flows through the second cooling bypass pipeline 230*b* and then the first evaporator 212*a*, to the suction port of the compressor 211 when the second defrost bypass pipeline 220*b* heats the second evaporator 212*b*. In other words, the bypass return pipeline 280 serves as a connecting channel between the outlet of the first evaporator 212*a* and the suction port of the compressor 211, and the refrigerant flowing out of the first evaporator 212*a* enables to directly return to the compressor 211 through the bypass return pipeline 280. For example, when the second evaporator 212*b* is being defrosted, the first evaporator 212*a* provides cooling using the refrigerant that flows through the second defrost bypass pipeline 220*b* and to the first evaporator 212*a* via the second cooling bypass pipeline 230*b*. The bypass return pipeline 280 guides the refrigerant flowing out of the first evaporator 212*a* to the suction port of the compressor 211 during the defrosting of the second evaporator 212*b*, thus completing a refrigeration-defrost cycle.

The refrigeration system 200 may further include a first switching valve 240 connected to the outlet of the first evaporator 212*a*. The inlet of the first switching valve 240 is connected to the outlet of the first evaporator 212*a*. The first switching valve 240 has a valve port connecting to the second evaporator 212*b* (i.e., the refrigerant flowing out of this valve port can flow towards the inlet of the second evaporator 212*b*), and a valve port connecting to the bypass return pipeline 280 (i.e., the refrigerant flowing out of this valve port can flow towards the bypass return pipeline 280). The first switching valve 240 can be a three-way valve, such as a three-way solenoid valve. The first switching valve 240 can be disposed in the storage compartment 110. In this and subsequent embodiments, the term "valve port" refers to the outlet of a switching valve.

The two valve ports of the first switching valve 240 are not opened simultaneously. The first switching valve 240 is used to open the valve port connecting to the bypass return pipeline 280 when the second defrost bypass pipeline 220*b* heats the second evaporator 212*b* using generated heat, so as to allow the refrigerant to return to the suction port of the compressor 211. And the first switching valve 240 opens the valve port connecting to the second evaporator 212*b* when both the first evaporator 212*a* and the second evaporator 212*b* provide cooling, so as to allow the refrigerant to flow through the second evaporator 212*b* and evaporate while absorbing heat.

In this embodiment, the first evaporator 212*a* and the second evaporator 212*b* are sequentially connected downstream of the exhaust port of the compressor 211. The refrigeration assembly 210 also include a refrigeration throttling device 214 and a condenser 213. The refrigeration throttling device 214 is set in the refrigeration circuit and upstream of the first evaporator 212*a*, and it throttles the refrigerant flowing towards the first evaporator 212*a*. The condenser 213 is connected between the exhaust port of the compressor 211 and the refrigeration throttling device 214. Thus, in this embodiment, the compressor 211, condenser 213, refrigeration throttling device 214, first evaporator 212*a*, and second evaporator 212*b* are sequentially connected to form the refrigeration circuit.

The refrigeration system 200 may further include a second switching valve 260 connected to the exhaust port of the compressor 211. The inlet of the second switching valve 260 is connected to the exhaust port of the compressor 211. The second switching valve 260 has a valve port connecting to the condenser 213 (i.e., the refrigerant flowing out of this valve port can flow towards the condenser 213), a valve port connecting to the first defrost bypass pipeline 220*a* (i.e., the refrigerant flowing out of this valve port can flow towards the first defrost bypass pipeline 220*a*), and a valve port connecting to the second defrost bypass pipeline 220*b* (i.e., the refrigerant flowing out of this valve port can flow towards the second defrost bypass pipeline 220*b*). The second switching valve 260 can be a four-way valve, such as a four-way solenoid valve. The second switching valve 260 may be disposed in a compressor compartment.

The three valve ports of the second switching valve 260 are not opened simultaneously. The second switching valve 260 is used to open the valve port connecting to the condenser 213 when both the first evaporator 212*a* and the second evaporator 212*b* provide cooling, to allow the refrigerant exiting the compressor 211 to sequentially flow through the condenser 213, the refrigeration throttling device 214, the first evaporator 212*a*, and the second evaporator 212*b*. When the first defrost bypass pipeline 220*a* heats the first evaporator 212*a* using generated heat, the second switching valve 260 opens the valve port connecting to the first defrost bypass pipeline 220*a*, so as to allow the refrigerant exiting the compressor 211 to flow directly into the first defrost bypass pipeline 220*a*, enabling the first evaporator 212*a* to defrost using the heat generated by the first defrost bypass pipeline 220*a*. When the second defrost bypass pipeline 220*b* heats the second evaporator 212*b* using generated heat, the second switching valve 260 opens the valve port connecting to the second defrost bypass pipeline 220*b*, so as to allow the refrigerant exiting the compressor 211 to flow directly into the second defrost bypass pipeline 220*b*, enabling the second evaporator 212*b* to defrost using the heat generated by the second defrost bypass pipeline 220*b*.

By adding the defrost bypass pipelines in the refrigeration system 200 and by arranging the cooling bypass pipelines at the outlet of each evaporator, and by using the first switching valve 240 and the second switching valve 260 to regulate the flow path of the refrigerant in the refrigeration circuit and the bypass branch, the refrigeration system 200 achieves simultaneous defrosting and cooling. Additionally, it effectively utilizes the mechanical work of the compressor 211 and has a compact structure.

Taking the defrosting of the first evaporator 212*a* as an example, the control process of the refrigeration system 200 will be introduced in detail. When the first evaporator 212*a* is defrosting, the second switching valve 260 opens the valve port connecting to the first defrost bypass pipeline 220*a* and closes other valve ports, the first switching valve 240 opens the valve port connecting to the second evaporator 212*b* and closes other valve ports. This enables the refrigerant to sequentially flow through the first defrost bypass pipeline 220*a*, the first cooling bypass pipeline 230*a*, the second evaporator 212*b*, and then return to the compressor 211, thereby completing the entire refrigeration-defrost cycle.

When the second evaporator 212*b* is defrosting, the second switching valve 260 opens the valve port connecting to the second defrost bypass pipeline 220*b* and closes other valve ports, the first switching valve 240 opens the valve port connecting to the bypass return pipeline 280 and closes other valve ports. This enables the refrigerant exiting the exhaust port of the compressor 211 to sequentially flow through the second defrost bypass pipeline 220*b*, the second cooling bypass pipeline 230*b*, the first evaporator 212*a*, and the bypass return pipeline 280, and then return to the compressor 211, thereby completing the entire refrigeration-defrost cycle.

The refrigeration system 200 of this embodiment, by using defrost bypass pipelines, cooling bypass pipelines, and switching valves to improve the connection structure of the refrigeration system 200, enables sequentially connected evaporators to defrost without temperature rise, and enhances the preservation performance of the refrigerating appliance 10. This is beneficial for simplifying the structure and the control process of the refrigeration system 200.

In this embodiment, the refrigeration assembly 210 may further include a liquid receiver 215 set within the refrigeration circuit, for example, between the outlet of the second evaporator 212*b* and the suction port of the compressor 211. The liquid receiver 215 is used for regulating the amount of refrigerant required by the various components of the refrigeration assembly 210.

The refrigeration assembly 210 may also further include a refrigeration return pipe 219 set within the refrigeration circuit, for example, between the outlet of the second evaporator 212*b* and the liquid receiver 215. The refrigeration return pipe 219 is used to reduce the superheat of the refrigerant returning to the suction port of the compressor 211.

Figure 3:
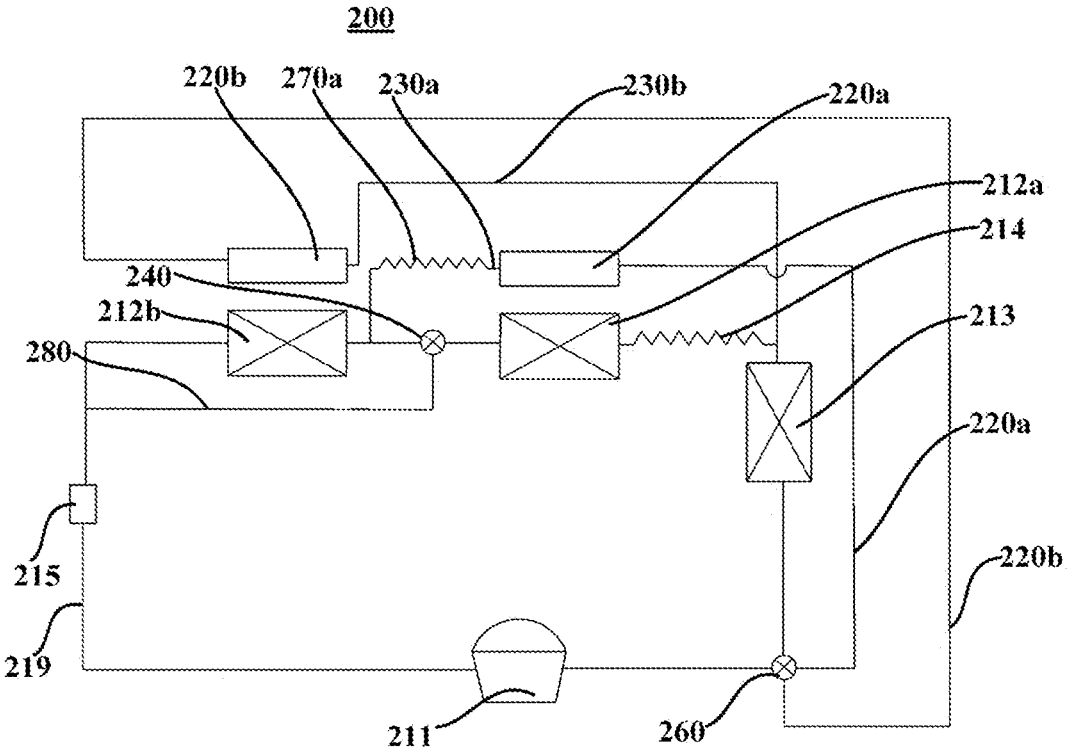
FIG. 3 is a schematic structural diagram of a refrigeration system for refrigerating appliance according to another embodiment of the present subject matter.

In some optional embodiments, the structure and connection manner of the second cooling bypass pipeline 230*b* can be varied. FIG. 3 is a schematic structural diagram of a refrigeration system for refrigerating appliance according to another embodiment of the present subject matter, in this embodiment, the outlet of the second cooling bypass pipeline 230*b* can be altered to connect to the inlet of the refrigeration throttling device 214. In this case, the second bypass throttling device 270*b* may not be required on the second cooling bypass pipeline 230*b*, thereby omitting a throttling device and further simplifying the structure of the refrigeration system 200.

Figure 4:
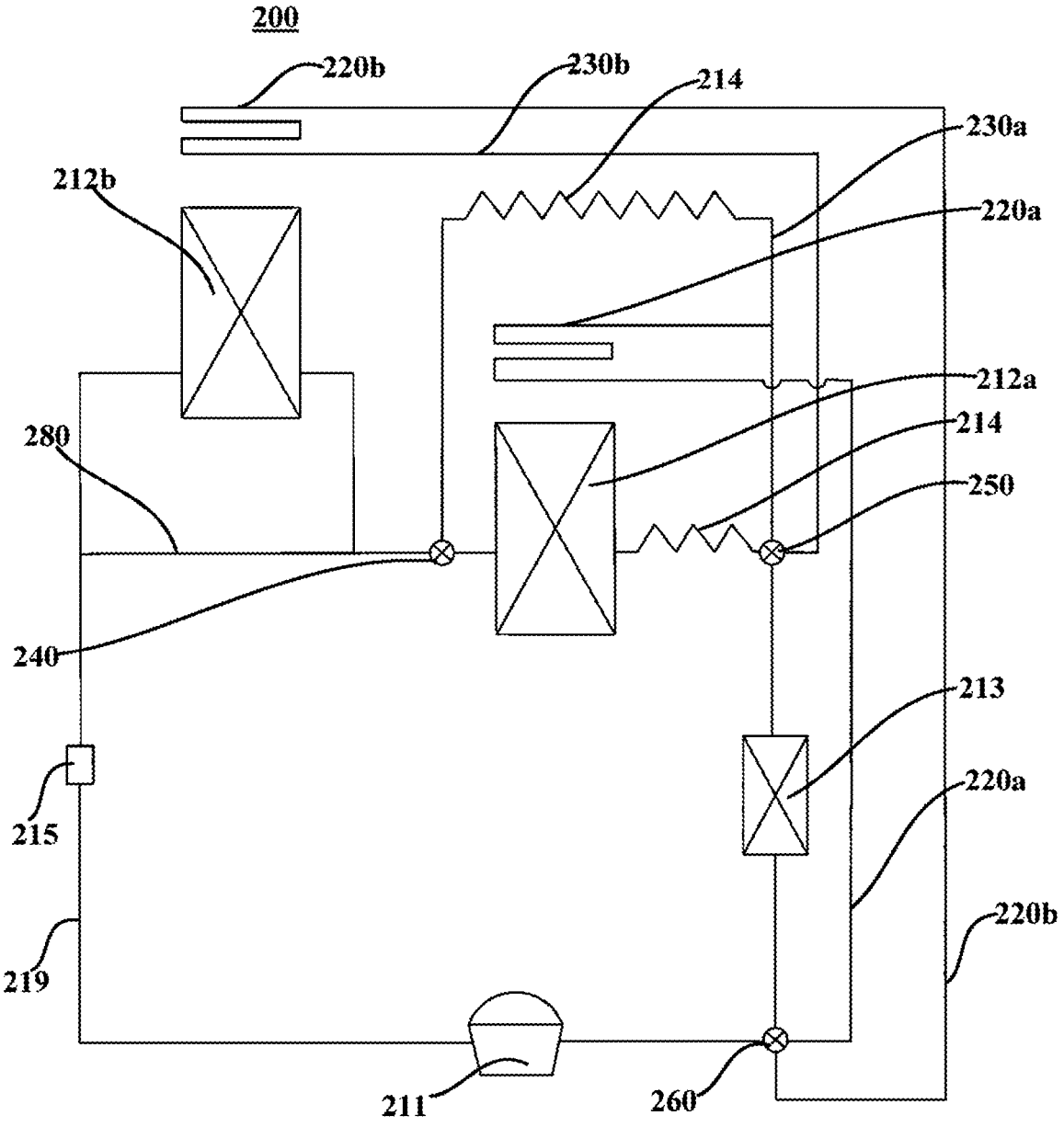
FIG. 4 is a schematic structural diagram of a refrigeration system for refrigerating appliance according to another embodiment of the present subject matter.

In other optional embodiments, the structure of the refrigeration assembly 210, as well as the structure and connection manner of the cooling bypass pipelines, can be varied. FIG. 4 is a schematic structural diagram of a refrigeration system for refrigerating appliance according to another embodiment of the present subject matter, in this embodiment, neither the first cooling bypass pipeline 230*a* nor the second cooling bypass pipeline 230*a* may require a bypass throttling device. In the refrigeration assembly 210, the refrigeration throttling device 214 can serve as a refrigeration throttling device 214 corresponding to the first evaporator 212*a*, and this refrigeration throttling device 214 and the first evaporator 212*a* being serially connected to form a first refrigeration branch. The refrigeration assembly 210 can further include an additional refrigeration throttling device 214 corresponding to the second evaporator 212*b*, and this refrigeration throttling device 214 is set in parallel with the first refrigeration branch and corresponds to the second evaporator 212*b*.

The outlet of the first cooling bypass pipeline 230*a* can be altered to connect to the inlet of the refrigeration throttling device 214 corresponding to the second evaporator 212*b*. The outlet of the second cooling bypass pipeline 230*b* can be altered to connect to the inlet of the refrigeration throttling device 214 corresponding to the first evaporator 212*a*. Correspondingly, the refrigeration system 200 can further include a third switching valve 250, which can be a dual-input and dual-output solenoid valve, that is, having two inlets and two outlets. For example, the third switching valve 250 may have an inlet connected to the outlet of the condenser 213 and an inlet connected to the outlet of the second cooling bypass pipeline 230*b*. The two outlets of the third switching valve 250 are each connected to one of the two refrigeration throttling devices 214. The third switching valve 250 can be disposed in the storage compartment 110.

When both the first evaporator 212*a* and the second evaporator 212*b* are providing cooling, the third switching valve 250 opens the inlet connected to the outlet of the condenser 213, and the second switching valve 260 opens at least one outlet connected to at least one refrigeration throttling device 214, and the first switching valve 240 opens the valve port connecting to the second evaporator 212*b*. When the first evaporator 212*a* is defrosting, the second switching valve 260 opens the valve port connecting to the first defrost bypass pipeline 220*a* and closes other valve ports, and all inlets and outlets of the third switching valve 250 are closed, and the first switching valve 240 opens the valve port connecting to the second evaporator 212*b*. When the second evaporator 212*b* is defrosting, the second switching valve 260 opens the valve port connecting to the second defrost bypass pipeline 220*b* and closes other valve ports, and the third switching valve 250 opens the inlet connected to the second cooling bypass pipeline 230*b* and the outlet connecting to the refrigeration throttling device 214 corresponding to the first evaporator 212*a*, and the first switching valve 240 opens the valve port connecting to the bypass return pipeline 280 and closes other valve ports.

By improving the structure of the refrigeration circuit and the bypass branch and using the third switching valve 250 to regulate the flow path of the refrigerant, the refrigeration system 200 can flexibly adjust the cooling effect of the first evaporator 212*a* and the second evaporator 212*b*, while also simplifying the structure of the cooling bypass pipelines. This allows each cooling bypass pipeline to omit the bypass throttling device.

Figure 5:
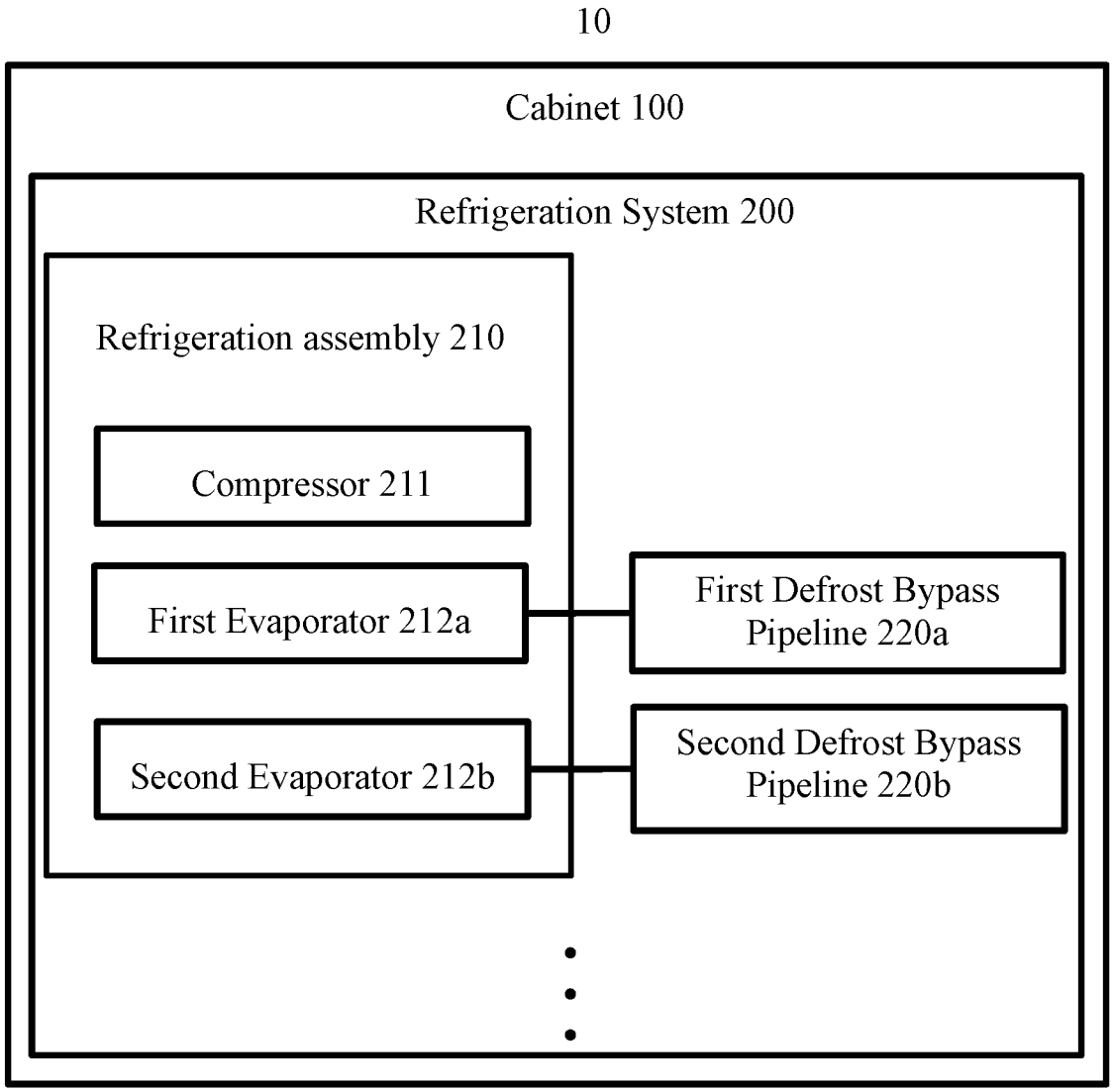
FIG. 5 is a schematic block diagram of a refrigerating appliance according to an embodiment of the present subject matter.

FIG. 5 is a schematic block diagram of a refrigerating appliance according to an embodiment of the present subject matter. The refrigerating appliance 10 generally includes a cabinet 100 and the refrigeration system 200 described in any of the above-mentioned embodiments.

A storage compartment 110 is formed inside the cabinet 100. There can be one storage compartment 110, and its temperature zone can be set according to actual needs. For example, the storage compartment 110 can be a refrigeration compartment, a freezing compartment, a cryogenic compartment, or a variable temperature compartment. The first evaporator 212*a* and the second evaporator 212*b* are used to provide cooling to this storage compartment 110.

Figure 6:
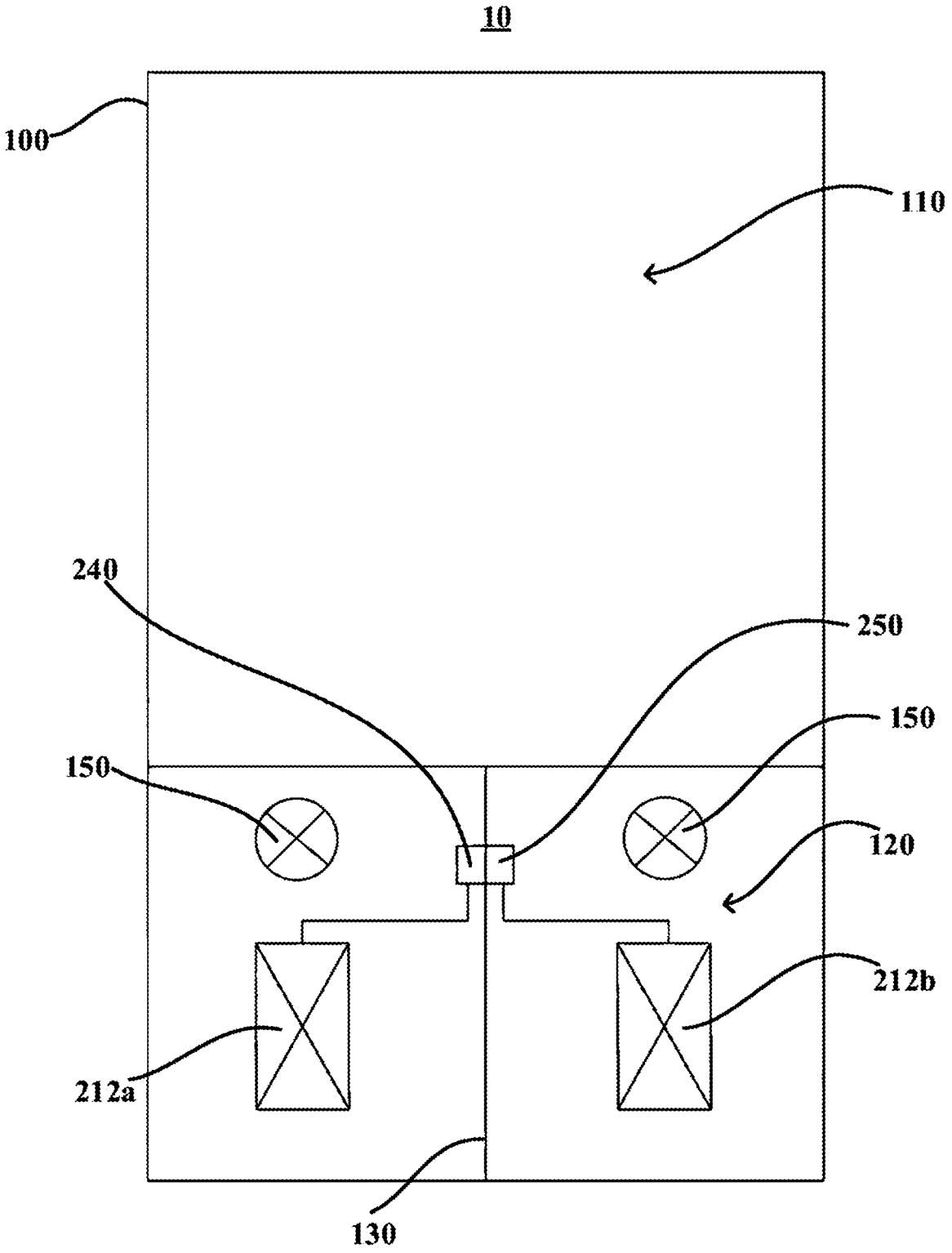
FIG. 6 is a schematic perspective view of a refrigerating appliance according to an embodiment of the present subject matter.

FIG. 6 is a schematic perspective view of a refrigerating appliance according to an embodiment of the present subject matter.

In some optional embodiments, there can be multiple storage compartments 110, such as two. The cooling provided by the two evaporators of the above-mentioned refrigeration system 200 can be supplied to the same storage compartment 110, such as a freezing compartment. In some optional embodiments, when suppling cooling to the same storage compartment 110, the cooling provided by the two evaporators of the refrigeration system 200 can also be supplied to other storage compartments 110, such as a refrigeration compartment, through air ducts, so as to share cooling among multiple storage compartments 110. In some other optional embodiments, each evaporator corresponds to one storage compartment 110, the two evaporators can cool their respective storage compartments 110, and when one evaporator is defrosting, the other evaporator can simultaneously cool both storage compartments 110.

In some optional embodiments, an installation space 120 for mounting evaporators also can be formed inside the cabinet 100, additionally. This installation space 120 can be located on one side of the storage compartment 110, such as the bottom or the rear side. The refrigerating appliance 10 can further include a thermal insulation partition 130 set within the installation space 120. The thermal insulation partition 130 divides the installation space 120 into two sub-spaces. These sub-spaces can be arranged side by side or one above the other, allowing the evaporators to be installed either in parallel or stacked. This can save installation space 120 for containing the evaporators, improve space utilization, and enhance aesthetic appeal.

Each sub-space is designated for containing one evaporator, so as to reduce heat exchange between the evaporators. This can prevent the heat generated by a defrosting evaporator from affecting the cooling effectiveness of the other evaporator.

Two air ducts corresponding to the evaporators one by one are formed inside the cabinet 100. Each air duct transports the cooling provided by its corresponding evaporator to the storage compartment 110. The air ducts are set independently to prevent turbulent airflow, ensuring efficient delivery of cooling, and improving the preservation effect in the storage compartment 110.

Correspondingly, the refrigerating appliance 10 can further include two fans 150 corresponding to the evaporators one by one. These fans 150 facilitate the formation of an exchange airflow through the corresponding air duct and the storage compartment 110 when the corresponding evaporator is providing cooling. Each fan 150 can be activated only when its corresponding evaporator is cooling. Additionally, by utilizing a fan shading, the fans 150 can prevent the heat generated during the defrosting of the evaporators from entering the storage compartment 110. In some optional embodiments, the number of fans 150 can be altered to one, and this single fan 150 is set on a common airflow path between the two air ducts and the storage compartment 110. Thus, the single fan 150 act as an airflow promoter for both air ducts, further simplifying the structure of the refrigerating appliance 10.

The refrigeration system 200 and refrigerating appliance 10 of the present invention, provides a novel defrosting method by improving the structure of the refrigeration system 200. Since the refrigeration circuit includes the first evaporator 212*a* and the second evaporator 212*b*, each evaporator is thermally connected to a defrost bypass pipeline and can utilize the heat generated by the defrost bypass pipeline for defrosting. By adjusting the circulation of refrigerant in the first defrost bypass pipeline 220*a* and the second defrost bypass pipeline 220*b*, the first evaporator 212*a* and the second evaporator 212*b* can be defrosted independently. When the first evaporator 212*a* and the second evaporator 212*b* are defrosted independently, the evaporator not undergoing defrosting can provide cooling, which enables the refrigeration system 200 of this embodiment to effectively prevent significant temperature fluctuations in the storage compartment 110 while improving the defrosting rate of the evaporators.

So far, it should be appreciated by those skilled in the art that while various exemplary embodiments of the utility model have been shown and described in detail herein, many other variations or modifications which are consistent with the principles of this utility model may be determined or derived directly from the disclosure of the present utility model without departing from the spirit and scope of the utility model. Accordingly, the scope of the utility model should be understood and interpreted to cover all such other variations or modifications.

What is claimed is:

1. A refrigeration system for a refrigerating appliance, comprising:

a refrigeration assembly comprising a compressor, a first evaporator, and a second evaporator, forming a refrigeration circuit;

defrost bypass pipelines having a first defrost bypass pipeline and a second defrost bypass pipeline for circulating refrigerant from the compressor to generate heat; the first defrost bypass pipeline is thermally connected to the first evaporator, and the second defrost bypass pipeline is thermally connected to the second evaporator; the refrigeration system is configured to provide cooling by one evaporator when the defrost bypass pipelines heat another evaporator, so as to prevent temperature fluctuations in a storage compartment of the refrigerating appliance; and cooling bypass pipelines comprising a first cooling bypass pipeline and a second cooling bypass pipeline; wherein the first cooling bypass pipeline is connected to the first defrost bypass pipeline, for guiding the refrigerant flowing through the first defrost bypass pipeline to the second evaporator, so that the second evaporator generates cooling; the second cooling bypass pipeline is connected to the second defrost bypass pipeline, for guiding the refrigerant flowing through the second defrost bypass pipeline to the first evaporator, so that the first evaporator generates cooling, and the refrigeration system further comprises:

a bypass return pipeline connecting the outlet of the first evaporator to a suction port of the compressor, and used for guiding the refrigerant flowing successively through the second cooling bypass pipeline and the first evaporator to the suction port of the compressor when the second defrost bypass pipeline heats the second evaporator.

2. The refrigeration system of claim 1, wherein:

the first cooling bypass pipeline is connected to the inlet of the second evaporator, a first bypass throttling device is arranged on the first cooling bypass pipeline for throttling the refrigerant flowing towards the second evaporator.

3. The refrigeration system of claim 1, wherein:

the second cooling bypass pipeline is connected to the inlet of the first evaporator, a second bypass throttling device is arranged on the second cooling bypass pipeline for throttling the refrigerant flowing towards the first evaporator.

4. The refrigeration system of claim 1, further comprising:

a first switching valve connected to the outlet of the first evaporator, and having a valve port connecting to the second evaporator, and a valve port connecting to the bypass return pipeline; the first switching valve opens the valve port connecting to the bypass return pipeline when the second defrost bypass pipeline heats the second evaporator using generated heat, and opens the valve port connecting to the second evaporator when both the first and second evaporators provide cooling.

5. The refrigeration system of claim 1, wherein:

the first evaporator and the second evaporator are sequentially connected downstream of an exhaust port of the compressor;

the refrigeration assembly further comprises a refrigeration throttling device setting in the refrigeration circuit and upstream of the first evaporator, and the refrigeration throttling device throttle the refrigerant flowing towards the first evaporator; and the second cooling bypass pipeline is connected to the inlet of the refrigeration throttling device.

6. The refrigeration system of claim 5, wherein:

the refrigeration assembly further comprises a condenser connected between the exhaust port of the compressor and the refrigeration throttling device; and the refrigeration system further comprises a second switching valve connected to the exhaust port of the compressor and having a valve port connecting to the condenser, a valve port connecting to the first defrost bypass pipeline, and a valve port connecting to the second defrost bypass pipeline;

the second switching valve opens the valve port connecting to the condenser when both the first and second evaporators provide cooling, opens the valve port connecting to the first defrost bypass pipeline when the first defrost bypass pipeline heats the first evaporator using generated heat, and opens the valve port connecting to the second defrost bypass pipeline when the second defrost bypass pipeline heats the second evaporator using generated heat.

7. The refrigeration system of claim 1, wherein:

the first defrost bypass pipeline is either coiled around the first evaporator or set adjacent to the first evaporator; the second defrost bypass pipeline is either coiled around the second evaporator or set adjacent to the second evaporator.

8. A refrigerating appliance, comprising:

a cabinet forming a storage compartment inside; and the refrigeration system of claim 1; where the first and second evaporators respectively provide cooling to the storage compartment.

* * * * *